US009770904B2

(12) United States Patent
Portela Mata et al.

(10) Patent No.: US 9,770,904 B2
(45) Date of Patent: Sep. 26, 2017

(54) FLUID DROP DETECTION IN FIRING PATHS CORRESPONDING TO NOZZLES OF A PRINTHEAD

(71) Applicant: HEWLETT-PACKARD DEVELOPMENT COMPANY, L. P., Houston, TX (US)

(72) Inventors: Laura Portela Mata, Sant Cugat del Valles (ES); David Soriano Fosas, Terrassa (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/650,168

(22) PCT Filed: Dec. 10, 2012

(86) PCT No.: PCT/US2012/068769

§ 371 (c)(1),
(2) Date: Jun. 5, 2015

(87) PCT Pub. No.: WO2014/092678

PCT Pub. Date: Jun. 19, 2014

(65) Prior Publication Data

US 2015/0367631 A1 Dec. 24, 2015

(51) Int. Cl.
*B41J 2/21* (2006.01)
*B41J 2/045* (2006.01)
(Continued)

(52) U.S. Cl.
CPC ..... *B41J 2/0456* (2013.01); *B41J 2/04586* (2013.01); *B41J 2/125* (2013.01);
(Continued)

(58) Field of Classification Search
CPC . B41J 2/125; B41J 2/145; B41J 29/393; B41J 29/39; B41J 2/0456; B41J 2/04586; B41J 2/2142; B41J 2/16579
(Continued)

(56) References Cited

U.S. PATENT DOCUMENTS 6,585,346 B2 * 7/2003 Endo ..... B41J 2/2139 347/14
6,648,444 B2 * 11/2003 Valero ..... B41J 29/393 347/19
(Continued)

FOREIGN PATENT DOCUMENTS

CN 102431301 5/2012
CN 102744971 10/2012
(Continued)

*Primary Examiner* — Sharon A Polk
(74) *Attorney, Agent, or Firm* — HP Inc.—Patent Department

(57) ABSTRACT

A method of operating a printing system includes identifying groups of nozzles of a plurality of nozzles of a printhead device. The method also includes ejecting fluid drops by the printhead device from nozzles thereof and along corresponding firing paths. The method also includes controlling movement of a detector carriage including a plurality of drop detectors of a drop detector array with respect to the printhead device by a control module to align each one of the drop detectors with the respective firing paths corresponding to the respective nozzles at a predetermined time. The method also includes sensing the firing paths corresponding to the nozzles to detect a presence of the fluid drops by the drop detectors such that each one of the drop detectors senses at a same time a respective firing path corresponding to a respective nozzle for a plurality of groups of nozzles.

18 Claims, 7 Drawing Sheets

(51) Int. Cl.
*B41J 2/165* (2006.01)
*B41J 2/125* (2006.01)
*B41J 29/393* (2006.01)

(52) U.S. Cl.
CPC ..... *B41J 2/16579* (2013.01); *B41J 2/2142* (2013.01); *B41J 29/393* (2013.01)

(58) Field of Classification Search
USPC ..... 347/14, 19
See application file for complete search history.

(56) References Cited

U.S. PATENT DOCUMENTS 8,172,356 B2 5/2012 Mata et al.
8,376,506 B2 * 2/2013 Shepherd ..... B41J 29/393 347/19
2002/0163551 A1 11/2002 Bruch et al.
2003/0090534 A1 5/2003 Valero et al.
2005/0030327 A1 * 2/2005 Tatsumi ..... B41J 2/16579 347/13
2007/0064041 A1 3/2007 Sugahara
2009/0033692 A1 2/2009 Giri et al.
2010/0259753 A1 10/2010 Shepherd et al.
2010/0289846 A1 * 11/2010 Portela ..... B41J 2/16579 347/19
2011/0141175 A1 6/2011 Murray et al.
2013/0320198 A1 * 12/2013 Govyadinov ..... B41J 2/04558 250/208.2
2014/0375718 A1 * 12/2014 Govyadinov ..... B41J 2/0456 347/14

FOREIGN PATENT DOCUMENTS

JP H06-122210 5/1994
JP 2004188930 A 7/2004
WO WO-2012128749 9/2012

* cited by examiner

FLUID DROP DETECTION IN FIRING PATHS CORRESPONDING TO NOZZLES OF A PRINTHEAD

BACKGROUND

Printing systems such as inkjet printers may include printheads having a plurality of nozzles. The printhead may eject fluid drops from the nozzles and along corresponding firing paths to form images on a substrate and/or to refresh the nozzles. Periodically, fluid drops may be prevented from being ejected from a respective nozzle due to a clog therein, a malfunctioning fluid drop ejection mechanism corresponding to the respective nozzle, and the like.

BRIEF DESCRIPTION OF THE DRAWINGS

Non-limiting examples are described in the following description, read with reference to the figures attached hereto, and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems such as inkjet printers may include printheads having a plurality of nozzles. The printhead may eject fluid drops from the nozzles and along corresponding firing paths to form images on a substrate. Each firing path may correspond to a fluid drop trajectory axis. Periodically, a previously healthy nozzle may become unhealthy. A healthy nozzle allows fluid drops to be properly ejected there from. Alternatively, an unhealthy nozzle prevents fluid drops from being properly ejected there from due to a clog therein, a malfunctioning fluid drop mechanism corresponding to the respective nozzle, and the like. Consequently, unhealthy nozzles may result in reduced image quality of the resulting image formed on the substrate and/or damage to the printhead.

In examples, a method of operating a printing system may include identifying groups of nozzles of a plurality of nozzles of a printhead device by a group identification module and ejecting fluid drops by the printhead device from nozzles thereof and along corresponding firing paths. The method may also include controlling movement of a detector carriage including a plurality of drop detectors of a drop detector array with respect to the printhead device by a control module to align the drop detectors with respective firing paths corresponding to respective nozzles at a predetermined time.

The method may also include sensing the firing paths corresponding to the nozzles to detect a presence of the fluid drops by the drop detectors to determine a nozzle health status for the respective nozzles such that each one of the drop detectors senses at a same time a respective firing path corresponding to a respective nozzle for a plurality of groups of nozzles. The ability of the drop detectors to align with and sense at a same time the corresponding firing paths increases the speed to sense the presence of fluid drops and/or determine a nozzle health status. Accordingly, unhealthy nozzles may be compensated for and/or fixed through maintenance routines. Thus, a reduction of image quality of the resulting image formed on the substrate and/or damage to the printhead due to unhealthy nozzles may be reduced.

Figure 1:
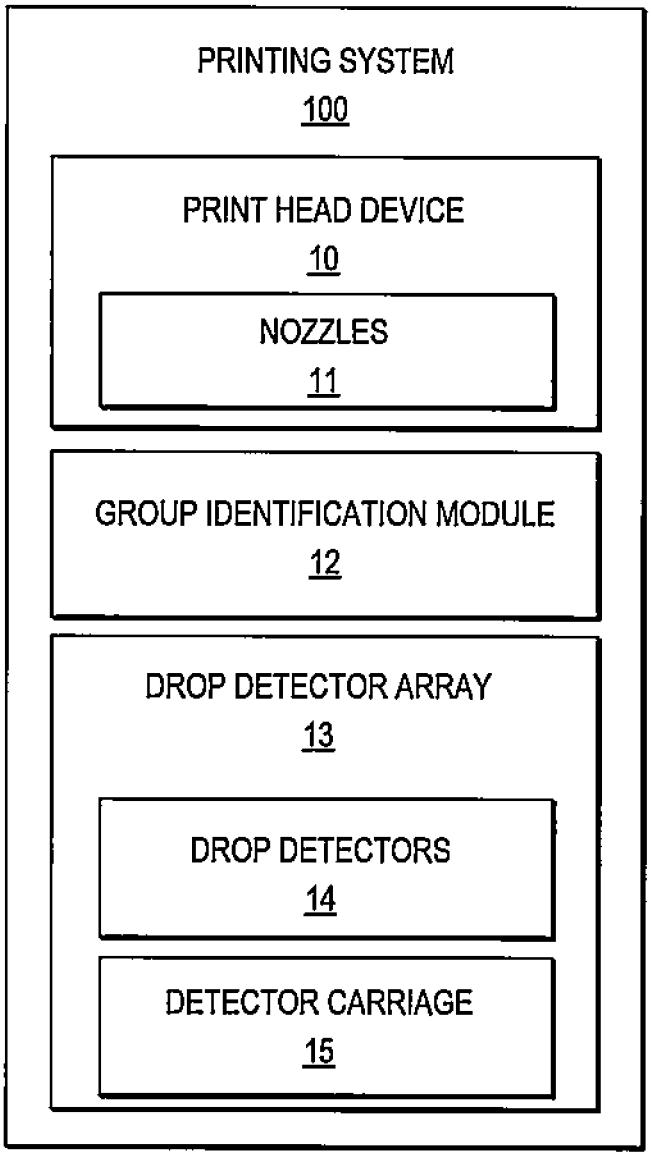
FIG. 1 is a block diagram illustrating a printing system according to an example.

FIG. 1 is a block diagram illustrating a printing system according to an example. Referring to FIG. 1, in some examples, a printing system 100 may include a printhead device 10 including a plurality of nozzles 11, a group identification module 12, and a drop detector array 13. The printhead device 10 may eject fluid drops from the nozzles 11 and along corresponding firing paths, respectively. For example, the fluid drops such as ink drops may be ejected to form an image on a substrate, refresh the nozzles, and/or be detected by the drop detector array 13. The group identification module 12 may identify groups of nozzles of the plurality of nozzles 11 of the printhead device 10. In some examples, the group identification module 12 may include a set of instructions to be implemented by a processor to identify the groups of nozzles. For example, each row of nozzles 11 of the printhead device 10 may be identified as a respective group of nozzles by the group identification module 12.

In some examples, the drop detector array 13 may include a plurality of drop detectors 14 disposed adjacent to each other and a detector carriage 15 coupled to the plurality of drop detectors 14. For example, the drop detector array 13 may include a printed circuit assembly (PCA) having the plurality of drop detectors 14 disposed thereon. The detector carriage 15 and the printhead device 10 may move with respect to each other. In some examples, the detector carriage 15 may be moved by a servo and/or motor along a track. The drop detectors 14 may sense the firing paths corresponding to the nozzles 11 to detect a presence of the fluid drops for the respective nozzles 11. Each one of the drop detectors 14 may sense at a same time a respective firing path corresponding to a respective nozzle for a plurality of groups of nozzles. Thus, firing paths corresponding to nozzles 11 of different groups of nozzles may be sensed at the same time by different drop detectors 14. For example, fluid drops may be ejected simultaneously from predetermined nozzles at a respective time and the detector carriage 15 may move the drop detector array 13 to a predetermined position such that respective firing paths corresponding to the predetermined nozzles may be sensed by the drop detectors 14, respectively, to detect the presence of the respective fluid drops at a same time.

Figure 2:
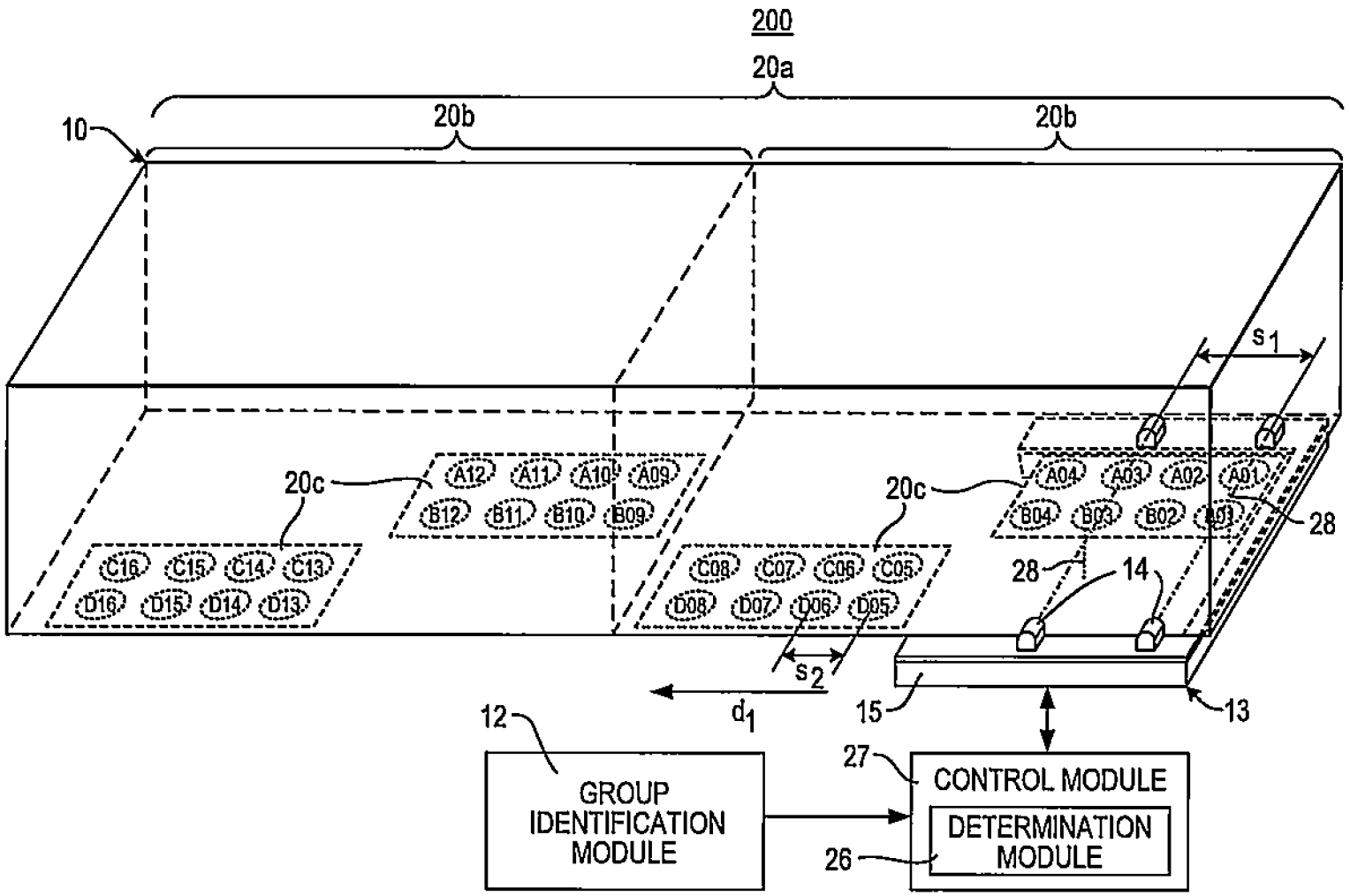
FIG. 2 is a perspective view of the printing system of FIG. 1 according to an example.
Figure 3:
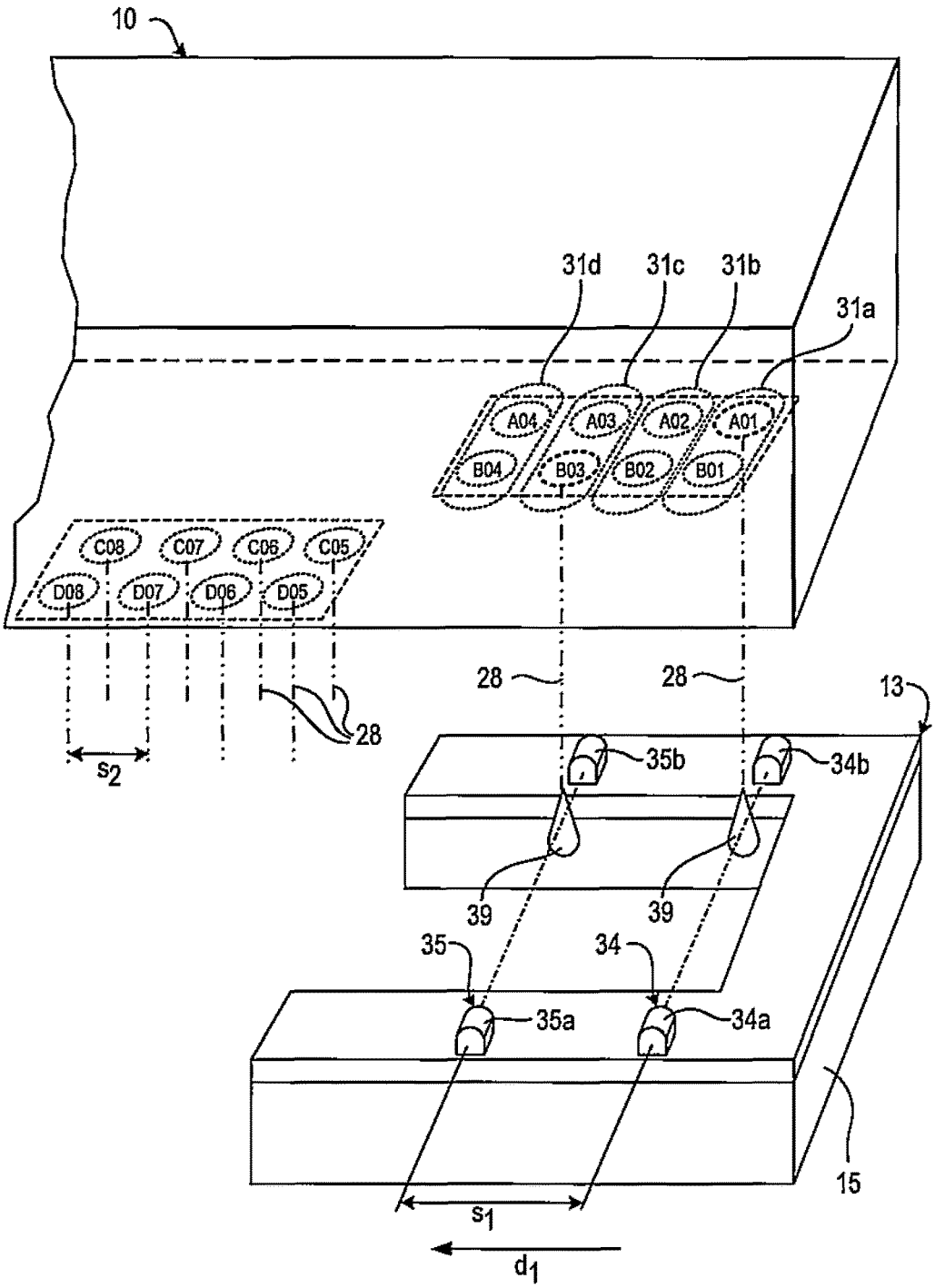
FIG. 3 is a perspective view of a drop detector array sensing fluid drops in respective firing paths corresponding to nozzles of a printhead device of the printing system of FIG. 2 according to an example.

FIG. 2 is a perspective view of the printing system of FIG. 1 according to an example. FIG. 3 is a perspective view of a drop detector array sensing fluid drops in respective firing paths corresponding to nozzles of a printhead device of the printing system of FIG. 2 according to an example. Referring to FIGS. 2-3, in some examples, the printing system 200 of FIG. 2 may include the printhead device 10 including a plurality of nozzles 11, the group identification module 12, and the drop detector array 13 as previously described with respect to FIG. 1. The printing system 200 may also include a control module 27 and a determination module 26. In some examples, the control module 27 may include the determination module 26. The plurality of nozzles 11 may be arranged as a two-dimensional array including rows and columns. In some examples, the rows and/or columns of nozzles may be staggered with respect to each other. Alternatively, the rows and/or columns of nozzles may be in a non-staggered arrangement with respect to each other.

The group identification module 12, the control module 27, and/or the determination module 26 may be implemented in hardware, software including firmware, or combinations thereof. The firmware, for example, may be stored in memory and executed by a suitable instruction-execution system. If implemented in hardware, as in an alternative example, the group identification module 12, the control module 27, and/or the determination module 26 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the group identification module 12, the control module 27, and/or the determination module 26 may be implemented in a combination of software and data executed and stored under the control of a computing device.

Referring to FIGS. 2-3, in some examples, the printing system 200 may include an inkjet printer and the printhead device 10 may include an inkjet page wide printhead. For example, the printhead device 10 may include a print bar 20*a* including a plurality of inkjet printhead modules 20*b* disposed adjacent to each other. Each one of the inkjet printhead modules 20*b* may include at least one printhead die 20*c* having nozzles A01-A04, A09-A12, B01-B04, B09-B12, C05-C08, C13-C16, D05-D08, D13-D16 (collectively 11) disposed thereon. For purposes of illustration, the printhead die 20*c* is illustrated with a 2 by 4 nozzle array. In some examples, the nozzle array may be less or greater than a 2 by 4 nozzle array. For example, the nozzle array may be a 12 by 88 nozzle array. In some examples, the nozzles 11 may be spaced apart from each other by a nozzle spacing distance $s_2$ in a first direction $d_1$, The first direction $d_1$ may be a travel direction in which the detector carriage 15 moves the drop detector array 13 with respect to the printhead device 10.

Firing paths 28 may extend downward from and be perpendicular to the corresponding nozzles 11. Thus, a spacing distance between the firing paths 28 may correspond with the nozzle spacing distance $s_2$ between the nozzles 11. Each nozzle 11 may have a corresponding firing path 28 for fluid drops ejected from the respective nozzle 11 to travel. In some examples, a respective firing path 28 may extend from a respective nozzle 11 to a substrate and/or spittoon, and the like.

Referring to FIGS. 2-3, in some examples, the group identification module 12 may identify groups of nozzles 31*a*, 31*b*, 31*c* and 31*d* (collectively 31) of the plurality of nozzles 11 of the printhead device 10. Additionally, each one of the groups of nozzles 31 identified by the group identification module 12 may include a number of nozzles 11 corresponding to a number of the drop detectors 14. For example, each group 31 may be made up of a total of two nozzles 11 when the drop detector array 13 is made up of a total of two drop detectors 34 and 35 (collectively 14). In some examples, the group identification module 12 may identify each row of nozzles as a group of nozzles 31. Alternatively, the group of nozzles 31 may include nozzles from different rows, and the like.

Referring to FIGS. 2-3, in some examples, the drop detectors 34 and 35 may include optical detectors. For example, each one of the plurality of drop detectors 34 and 35 may include a detector receiver 34*b* and 35*b* and a detector source 34*a* and 35*a* spaced apart from the detector receiver 34*b* and 35*b*. The detector source 34*a* and 35*a* may emit a signal 34*c* and 35*c* such as a light beam to the detector receiver 34*b* and 35*b* to detect the presence of respective fluid drops 39 passing through the signal 34*c* and 35*c*. In some examples, the spacing between the detector receiver 34*b* and 35*b* and the corresponding detector source 34*a* and 35*a* may be greater than a width of a plurality of columns of printhead dies 20*c*. For purposes of illustration, the drop detector array 13 is illustrated including two drop detectors 34 and 35. In some examples, the drop detector array 13 may include more than two drop detectors 34 and 35 such as twelve drop detectors, and the like. In some examples, the drop detectors may be disposed adjacent and proximate to each other to reduce the size of the drop detector array 13.

Each one of the drop detectors 34 and 35 may be spaced apart from each other in a first direction $d_1$ by a predetermined sensor spacing distance $s_1$. In some examples, the respective firing path 28 corresponding to the respective nozzle 11 for a plurality of groups of nozzles 31 may be sensed at the same time. Additionally, the respective firing path 28 corresponding to the respective nozzle 11 for a plurality of groups of nozzles 31 may be spaced apart from each other in the first direction $d_1$ by the predetermined sensor spacing distance $s_1$. For purposes of illustration, the predetermined sensor spacing distance $s_1$ is illustrated as twice the nozzle spacing distance $s_2$ in the first direction $d_1$. Alternatively, in some examples, the predetermined sensor spacing distance $s_1$ may be greater than twice the nozzle spacing distance $s_2$ in the first direction $d_1$. For example, the nozzle spacing distance $s_2$ may be approximately 21 micrometers and the sensor spacing distance $s_1$ may be approximately 9.324 millimeters, and the like.

Referring to FIGS. 2-3, in some examples, the control module 27 may control movement of the detector carriage 15 with respect to the printhead device 10 to align each one of the drop detectors 14 with the respective firing path 28 corresponding to the respective nozzle 11 for the plurality of groups of nozzles 31 at a predetermined time. In some examples, the control module 27 may control movement of the detector carriage 15 at a constant speed in an orthogonal direction with respect to the firing paths 28 corresponding to the nozzles 11 and in synchronization with the fluid drops 39 ejected from the nozzles 11. For example, the nozzles 11 may be equally spaced in the travel direction of the detector carriage 15 to be moved with respect to the printhead device 10 to allow the detector carriage 15 to move at a constant speed while the drop detectors 35 and 35 sense the respective firing paths 28 in an efficient and speedy manner.

The determination module 26 may determine the nozzle health status for the respective nozzles 11. For example, a respective nozzle 11 may be determined to be a healthy nozzle in response to a detection of a respective fluid drop 39 by the drop detector array 13 in a respective firing path 28 corresponding thereto. Additionally, a respective nozzle 11 may be determined to be an unhealthy nozzle in response to a detection of an absence of a respective fluid drop by the drop detector array 13 in a respective firing path 28 corresponding thereto. In some examples, the fluid drops intended to be ejected from the unhealthy nozzles may be ejected from other healthy nozzles and/or maintenance routines may be performed on the unhealthy nozzles.

Figure 4A:
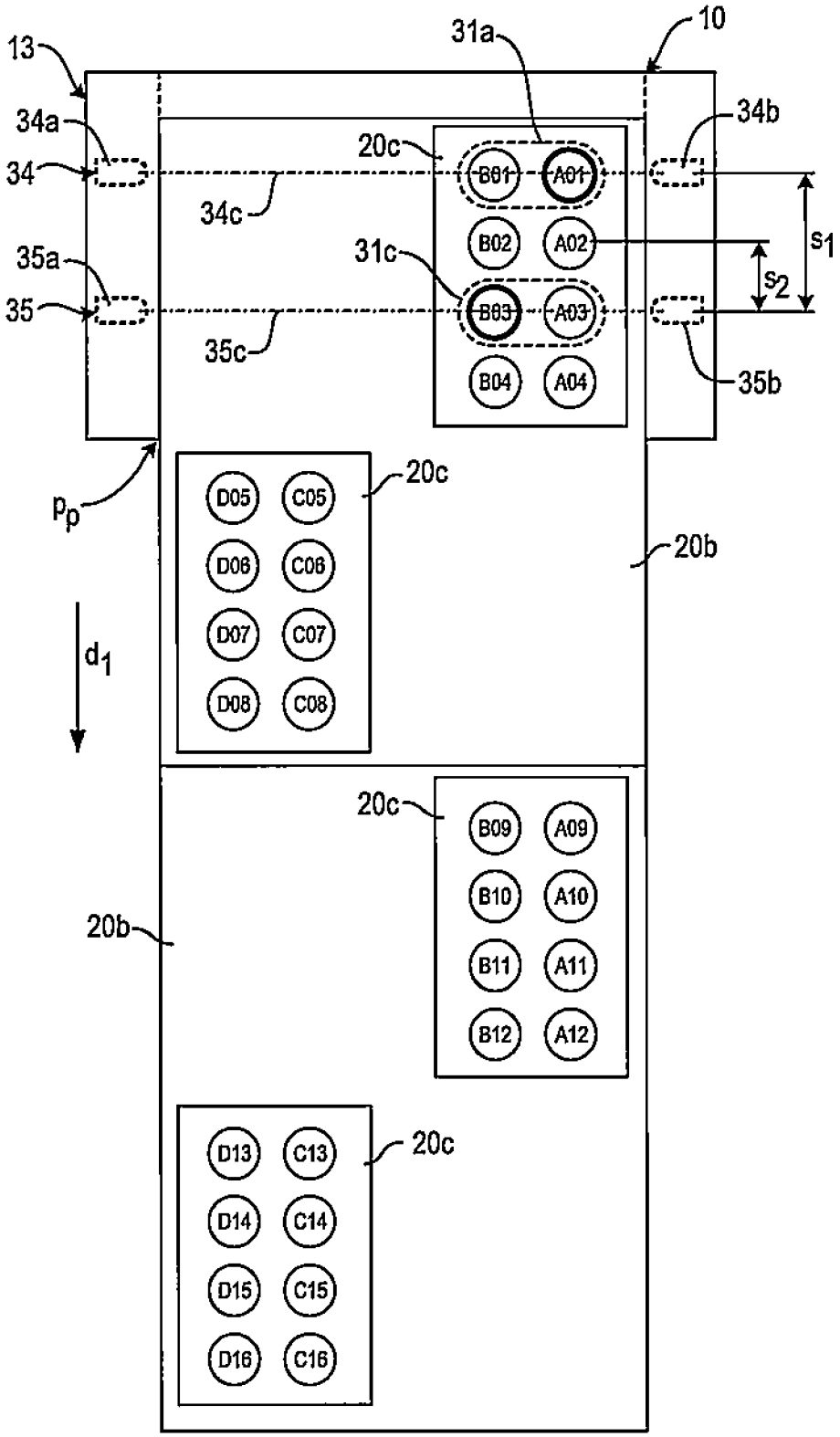
FIGS. 4A and 4B are schematic views of a drop detector array in alignment with respect to groups of nozzles of a printhead device of the printing system of FIG. 2 according to examples.
Figure 4B:
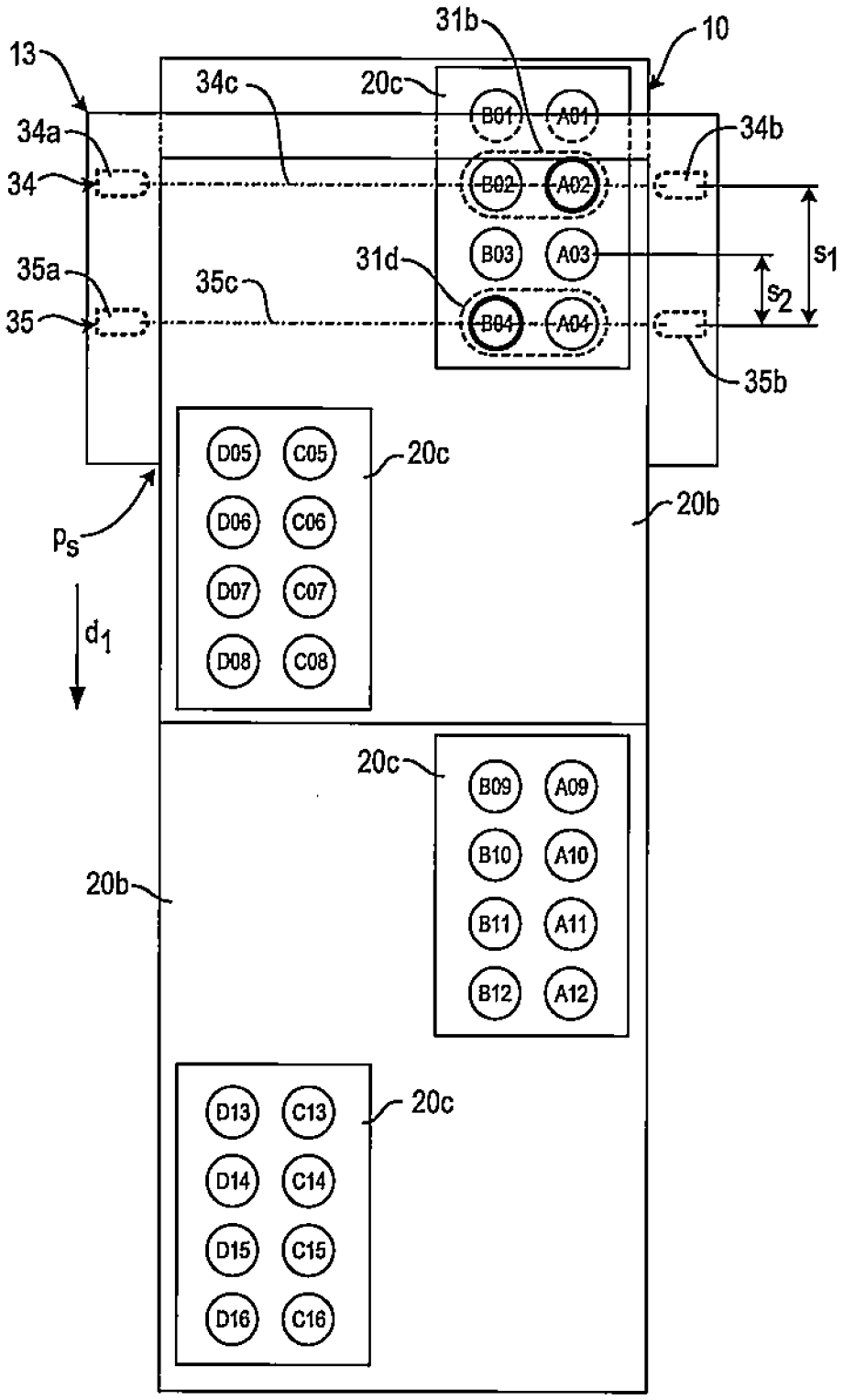

FIGS. 4A and 4B are schematic views of a drop detector array in alignment with respect to groups of nozzles of a printhead device of the printing system of FIG. 2 according to examples. Referring to FIGS. 4A and 4B, in some examples, the printhead device 10 may include a print bar including a plurality of inkjet printhead modules 20*b* disposed adjacent to each other. Each one of the inkjet printhead modules 20*b* may include at least one printhead die 20*c* having nozzles A01-A04, A09-A12, B01-B04, B09-B12, C05-C08, C13-C16, D05-D08, D13-D16 (collectively 11) disposed thereon. For example, the first printhead die 20*c* may include nozzles A01-A04 and B01-B04. Each row of nozzles may be identified as a respective group of nozzles 31. That is, nozzle A01 and nozzle B01 may be identified as a first group of nozzles 31*a*. Nozzle A02 and nozzle B02 may be identified as a second group of nozzles 31*b*. Nozzle A03 and nozzle B03 may be identified as a third group of nozzles 31*c*. Additionally, nozzle A04 and nozzle B04 may be identified as a fourth group of nozzles 31*d*.

As illustrated in FIG. 4A, at a predetermined time, the drop detector array 13 may be aligned with respect to the printhead device 10. In some examples, as the sensor spacing distance $s_1$ may be twice the nozzle spacing distance $s_2$, a first drop detector 34 may align with a respective firing path 28 (FIG. 3) of a respective nozzle A01 corresponding to a first group of nozzles 31*a* and the second drop detector 35 may align with a respective firing path 28 of a respective nozzle B03 corresponding to the third group of nozzles 31*c*. The printhead device 10 may eject fluid drops from a respective nozzle A01 and B03 for a plurality of groups of nozzles 31*a* and 31*c*. That is, the printhead device 10 may eject fluid drops from a first nozzle A01 of the first group of nozzles 31*a* and a second nozzle B03 of the third group of nozzles 31*c*.

Each one of the drop detectors 34 and 35 may sense at a same time a respective firing path 28 corresponding to a respective nozzle A01 and B03 for a plurality of groups of nozzles 31*a* and 31*c*. That is, the first drop detector 34 may sense a respective firing path 28 corresponding to the first nozzle A01 of the first group of nozzles 31*a* and the second drop detector 35 may sense a respective firing path 28 corresponding to the second nozzle B03 of the third group of nozzles 31*c* at a same time. Thus, in some examples, at a predetermined time and with the drop detector array 13 at a predetermined position $p_p$ with respect to the printhead device 10, the plurality of drop detectors 34 and 35 may sense respective firing paths 28 corresponding to respective nozzles A01 and B03 of different groups of nozzles 31*a* and 31*c* to detect the presence of the fluid drops.

As illustrated in FIG. 4B, at a subsequent predetermined time, the drop detector array 13 may move by a nozzle spacing distance $s_2$ in the first direction $d_1$ to align the drop detectors 34 and 35 with other groups of nozzles 31*b* and 31*d*. That is, the first drop detector 34 may align with a respective firing path 28 (FIG. 3) of a respective nozzle A02 corresponding to a second group of nozzles 31*a* and the second drop detector 35 may align with a respective firing path 28 of a respective nozzle 604 corresponding to a fourth group of nozzles 31*d*. The printhead device 10 may eject fluid drops from a respective nozzle A02 and B04 for a plurality of groups of nozzles 31*b* and 31*d*. That is, the printhead device 10 may eject fluid drops from a first nozzle A02 of the second group of nozzles 31*b* and a second nozzle B04 of the fourth group of nozzles 31*d*.

Each one of the drop detectors 34 and 35 may sense at a same time a respective firing path 28 corresponding to a respective nozzle A02 and B04 for a plurality of groups of nozzles 31*b* and 31*d*. That is, the first drop detector 34 may sense a respective firing path 28 corresponding to the first nozzle A02 of the second group of nozzles 31*b* and the second drop detector 35 may sense a respective firing path 28 corresponding to the second nozzle B04 of the fourth group of nozzles 31*d* at a same time. Thus, in some examples, at a subsequent predetermined time and with the drop detector array 13 at a subsequent predetermined position $p_s$ with respect to the printhead device 10, the plurality of drop detectors 34 and 35 may sense respective firing paths 28 corresponding to respective nozzles A02 and B04 of different groups of nozzles 31*b* and 31*d* to detect a presence of the fluid drops. In some examples, the drop detector array 13 may continue to move in the first direction $d_1$ to align the drop detectors 34 and 35 to sense the firing paths 28 corresponding to the remaining nozzles to detect the presence of the fluid drops. The remaining nozzles, for example, may correspond to nozzles of a plurality of printhead dies 20*c* and/or inkjet printhead modules 20*b* of the printhead device 10.

Figure 5:
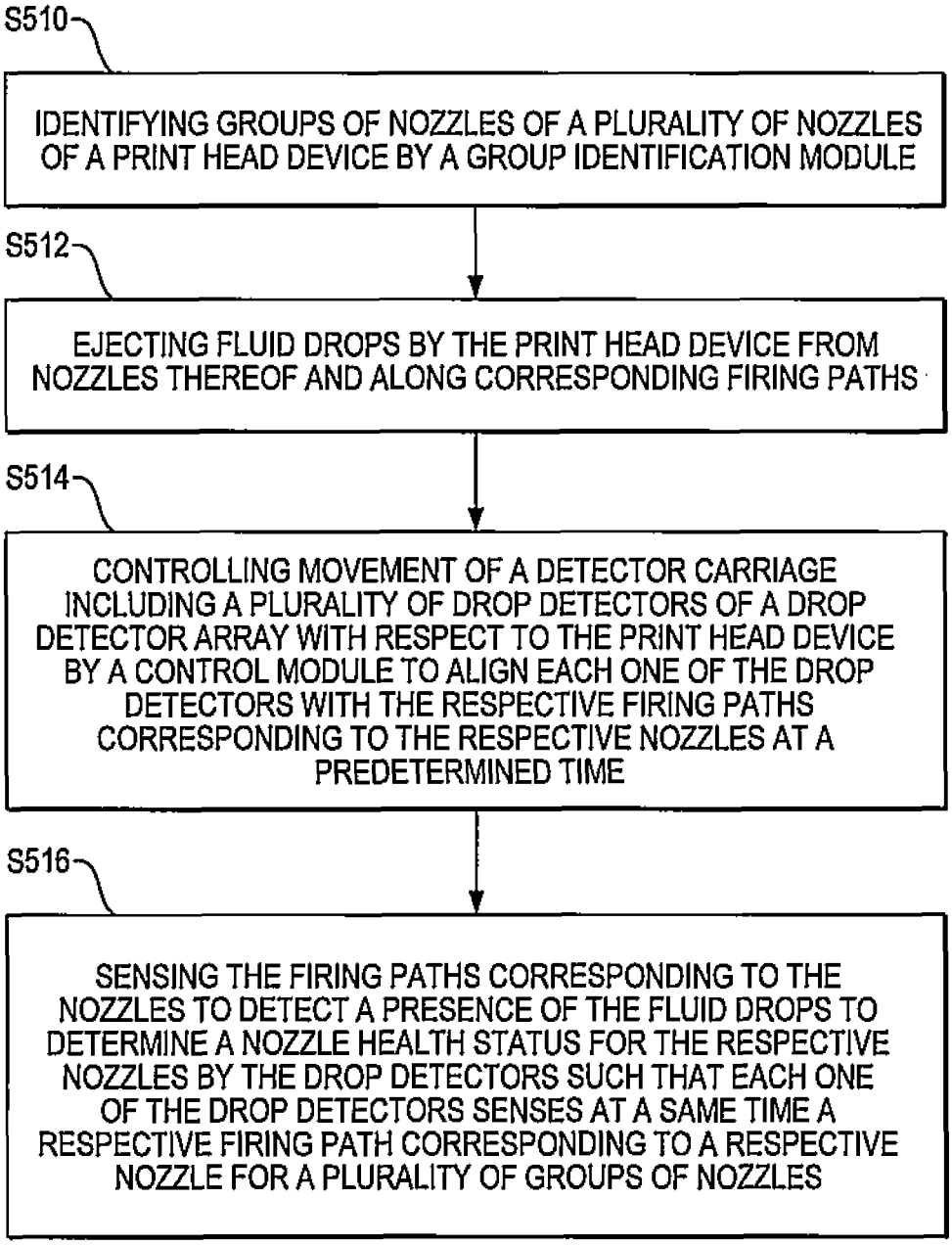
FIG. 5 is a flowchart illustrating a method of operating a printing system according to an example.

FIG. 5 is a flowchart illustrating a method of operating a printing system according to an example. Referring to FIG. 5, in block S510, groups of nozzles of a plurality of nozzles of a printhead device are identified by a group identification module. In some examples, identifying groups of nozzles of a plurality of nozzles of a printhead device by a group identification module may also include identifying a number of nozzles corresponding to a number of the drop detectors for each of a plurality of groups of nozzles.

In block S512, fluid drops are ejected by the printhead device from nozzles thereof and along corresponding firing paths. In some examples, ejecting fluid drops by the printhead device from nozzles thereof and along corresponding firing paths may also include ejecting fluid drops from a first set of nozzles including a corresponding nozzle from a first subset of the plurality of groups of nozzles at a predetermined time to coincide with the detector carriage arriving at a predetermined position. Additionally, ejecting fluid drops by the printhead device from nozzles thereof and along corresponding firing paths may also include ejecting fluid drops from a second set of nozzles different than the first set of nozzles and including a corresponding nozzle from a second subset of the plurality of groups of nozzles at a subsequent predetermined time to coincide with the detector carriage arriving at a subsequent predetermined position.

In block S514, movement of a detector carriage including a plurality of drop detectors of a drop detector array is controlled with respect to the printhead device by a control module to align each one of the drop detectors with the respective firing paths corresponding to the respective nozzles at a predetermined time. In some examples, controlling movement of a detector carriage may also include controlling movement of the detector carriage at a constant speed in an orthogonal direction with respect to the firing paths corresponding to the nozzles and in synchronization with the fluid drops ejected from the nozzles.

In block S516, the firing paths corresponding to the nozzles are sensed to detect a presence of the fluid drops by the drop detectors to determine a nozzle health status for the respective nozzles such that each one of the drop detectors senses at a same time a respective firing path corresponding to a respective nozzle for a plurality of groups of nozzles. The method may also include determining a respective nozzle to be a healthy nozzle by a determination module in response to a detection by the drop detector array of a respective fluid drop in a respective firing path corresponding thereto and an unhealthy nozzle in response to a detection of an absence of a respective fluid drop in a respective firing path corresponding thereto.

Figure 6:
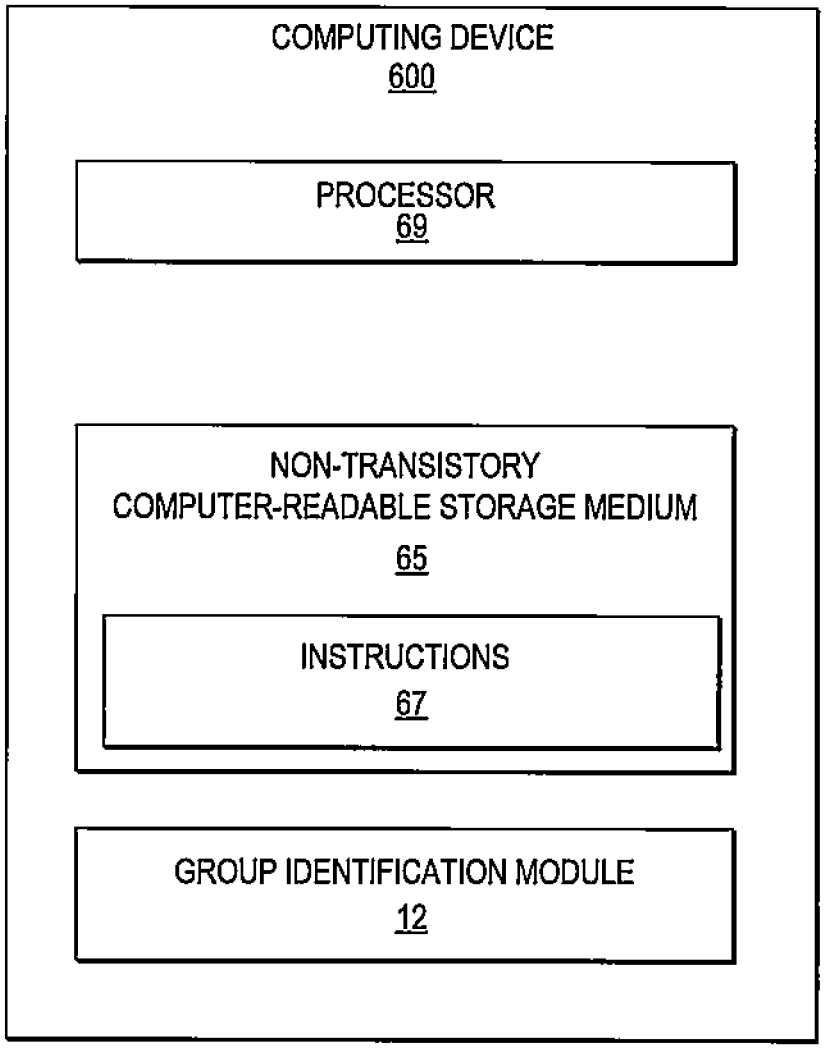
FIG. 6 is a block diagram illustrating a computing device such as a printing system including a processor and a non-transitory, computer-readable storage medium to store instructions to operate the printing system according to an example.

FIG. 6 is a block diagram illustrating a computing device such as a printing system including a processor and a non-transitory, computer-readable storage medium to store instructions to operate the printing system according to an example. Referring to FIG. 6, in some examples, the non-transitory, computer-readable storage medium 65 may be included in a computing device 600 such as a printing system including a group identification module 12. In some examples, the non-transitory, computer-readable storage medium 65 may be implemented in whole or in part as instructions 67 such as computer-implemented instructions stored in the computing device locally or remotely, for example, in a server or a host computing device which may be considered herein to be part of the printing system.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 600 such as a printing system in accordance with an example. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printing system, comprising:

a printhead device including a plurality of nozzles, the printhead device to eject fluid drops from the nozzles and along corresponding firing paths, respectively;

a group identification module to identify groups of nozzles of the plurality of nozzles of the printhead device; and a drop detector array including a plurality of drop detectors disposed adjacent to each other and a detector carriage coupled to the plurality of drop detectors;

the drop detectors to sense the firing paths corresponding to the nozzles to detect a presence of the fluid drops for the respective nozzles, wherein the groups of nozzles are spaced so that each one of the drop detectors is to sense, at a same time, a respective firing path corresponding to a respective nozzle for a different group of nozzles; and the detector carriage and the printhead device to move with respect to each other, wherein a spacing between drop detectors corresponds to a spacing between different groups of nozzles such that the controlled movement of the detector carriage simultaneously aligns different drop detectors with nozzles from different groups of nozzles.

2. The printing system according to claim 1, wherein each one of the drop detectors is spaced apart from each other in a first direction by a predetermined sensor spacing distance.

3. The printing system according to claim 2, wherein the respective firing path corresponding to the respective nozzle for the plurality of groups of nozzles to be sensed at the same time is spaced apart from each other in the first direction by the predetermined sensor spacing distance.

4. The printing system according to claim 1, further comprising: a control module to control movement of the detector carriage with respect to the printhead device to align each one of the drop detectors with the respective firing path corresponding to the respective nozzle for the plurality of groups of nozzles at a predetermined time.

5. The printing system according to claim 4, wherein the control module is configured to control movement of the detector carriage at a constant speed in an orthogonal direction with respect to the firing paths corresponding to the nozzles and in synchronization with the fluid drops ejected from the nozzles.

6. The printing system according to claim 1, wherein each of the plurality of groups of nozzles identified by the group identification module includes a number of nozzles equal to a number of the drop detectors.

7. The printing system according to claim 1, further comprising: a determination module to determine a nozzle health status for the respective nozzles such that a respective nozzle is determined to be a healthy nozzle in response to a detection of a respective fluid drop in a respective firing path corresponding thereto and an unhealthy nozzle in response to a detection of an absence of a respective fluid drop in a respective firing path corresponding thereto by the drop detector array.

8. The printing system according to claim 1, wherein each one of the plurality of drop detectors further comprises: a detector receiver; and a detector source spaced apart from the detector receiver, the detector source to emit a signal to the detector receiver to detect the presence of respective fluid drops passing through the signal.

9. The printing system according to claim 1, wherein the printhead device further comprises: a print bar including a plurality of inkjet printhead modules disposed adjacent to each other, each one of the inkjet printhead modules including at least one printhead die having nozzles disposed thereon.

10. The printing system of claim 1, wherein a group of nozzles consists of two nozzles.

11. The printing system of claim 1, wherein a group of nozzles comprises a linear row of nozzles on the printhead device.

12. The printing system of claim 1, wherein each group of nozzles comprises a number of nozzles equal to a number of the drop detectors of the drop detector array.

13. A method of operating a printing system, the method comprising:

identifying groups of nozzles of a plurality of nozzles of a printhead device by a group identification module;

ejecting fluid drops by the printhead device from nozzles thereof and along corresponding firing paths;

controlling movement of a detector carriage including a plurality of drop detectors of a drop detector array with respect to thee printhead device by a control module to align the drop detectors with respective firing paths corresponding to respective nozzles at a predetermined time, wherein a spacing between drop detectors corresponds to a spacing between different groups of nozzles such that the controlled movement of the detector carriage simultaneously aligns different drop detectors with nozzles from different groups of nozzles; and sensing the respective firing paths corresponding to the respective nozzles to detect a presence of fluid drops by the drop detectors to determine a nozzle health status for the respective nozzles such that each one of the drop detectors senses at a same time a respective firing path corresponding to a respective nozzle for a plurality of groups of nozzles;

wherein the identifying groups of nozzles of a plurality of nozzles of a printhead device by a group identification module further comprises: identifying a number of nozzles corresponding to a number of the drop detectors for each of the plurality of the groups of nozzles.

14. The method according to claim 13, wherein the controlling movement of a detector carriage further comprises: controlling movement of the detector carriage at a constant speed in an orthogonal direction with respect to the firing paths corresponding to the nozzles and in synchronization with the fluid drops ejected from the nozzles.

15. The method according to claim 13, wherein the ejecting fluid drops by the printhead device from nozzles thereof and along corresponding firing paths further comprises:

ejecting fluid drops from a first set of nozzles including a corresponding nozzle from a first subset of the plurality of groups of nozzles at a predetermined time to coincide with the detector carriage arriving at a predetermined position; and ejecting fluid drops from a second set of nozzles different than the first set of nozzles and including a corresponding nozzle from a second subset of the plurality of groups of nozzles at a subsequent predetermined time to coincide with the detector carriage arriving at a subsequent predetermined position.

16. The method according to claim 13, further comprising: determining a respective nozzle to be a healthy nozzle by a determination module in response to a detection by the drop detector array of a respective fluid drop in a respective firing path corresponding thereto and an unhealthy nozzle in response to a detection an absence of a respective fluid drop in a respective firing path corresponding thereto.

17. A non-transitory computer-readable storage medium having computer executable instructions stored thereon to operate a printing system, the instructions are executable by a processor to direct:

a printhead device to eject fluid drops from nozzles thereof and along corresponding firing paths, the nozzles being assigned to respective group of nozzles;

a control module to control movement of a detector carriage including a plurality of drop detectors of a drop detector array with respect to the printhead device at a constant speed in an orthogonal direction with respect to the firing paths corresponding to the nozzles and in synchronization with the fluid drops ejected from the nozzles; and the drop detectors to sense the firing paths corresponding to the nozzles to detect a presence of the fluid drops to determine a nozzle health status for the respective nozzles such that each one of the drop detectors senses at a same time a respective firing path corresponding to a respective nozzle for a plurality of groups of nozzles;

wherein a spacing between different groups of nozzles corresponds to a spacing between drop detectors such that movement of the detector carriage by the processor simultaneously aligns different drop detectors with nozzles from different groups of nozzles.

18. The printing system of claim 17, wherein the spacing between drop detectors is twice the spacing between adjacent groups of nozzles.

* * * * *